US009004508B2

(12) United States Patent
Tsukada et al.

(10) Patent No.: US 9,004,508 B2
(45) Date of Patent: Apr. 14, 2015

(54) MOVABLE BED

(71) Applicant: Panasonic Corporation, Osaka (JP)

(72) Inventors: Shohei Tsukada, Hyogo (JP); Hideo Kawakami, Osaka (JP); Tohru Nakamura, Osaka (JP); Ryuichi Ueda, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 14/356,695

(22) PCT Filed: Jul. 4, 2013

(86) PCT No.: PCT/JP2013/004165
§ 371 (c)(1),
(2) Date: May 7, 2014

(87) PCT Pub. No.: WO2014/006912
PCT Pub. Date: Jan. 9, 2014

(65) Prior Publication Data

US 2014/0319804 A1 Oct. 30, 2014

(30) Foreign Application Priority Data

Jul. 5, 2012 (JP) ..... 2012-151081

(51) Int. Cl.
*A61G 5/00* (2006.01)
*A61G 7/00* (2006.01)
(Continued)

(52) U.S. Cl.
CPC ..... *A61G 5/006* (2013.01); *A61G 7/015* (2013.01); *A61G 2007/165* (2013.01); *A61G 7/16* (2013.01); *A61G 7/00* (2013.01)

(58) Field of Classification Search
USPC ..... 280/47.38, 47.4; 5/86.1
See application file for complete search history.

(56) References Cited

U.S. PATENT DOCUMENTS 3,138,805 A * 6/1964 Piazza ..... 5/618
3,284,126 A * 11/1966 Piazza ..... 296/20
(Continued)

FOREIGN PATENT DOCUMENTS

JP 5-51330 7/1993
JP 2000-325406 11/2000
(Continued)

OTHER PUBLICATIONS

English translation of the Written Opinion of the International Searching Authority issued Jun. 27, 2014 in International (PCT) Application No. PCT/JP2013/004165.
(Continued)

*Primary Examiner* — Jeffrey J Restifo
(74) *Attorney, Agent, or Firm* — Wenderoth, Lind & Ponack, L.L.P.

(57) ABSTRACT

In a movable bed composed by combining a bed main portion and a wheelchair, the wheelchair has chair back bottom rails having cutout portions in a chair back bottom, and a chair back guide portion installed rotatably about a rotation point with respect to a chair base portion, the chair back guide portion having sliding portions engaged with the chair back bottom rails so as to be slidable and arranged to be disengageable from the chair back bottom rails by being located in the cutout portions, and in a fourth state (flat posture), the sliding portions are located in the cutout portions, the chair back guide portion and the chair back bottom are disengaged so as to be separable from each other, and a back lifting posture of the bed main portion and the chair back bottom can be performed over the entire width of the bed, whereas in a first state (chair posture), the sliding portions are engaged with the chair back bottom rails and can slide along the chair back bottom rails.

14 Claims, 12 Drawing Sheets

(51) Int. Cl.
*A61G 7/015* (2006.01)
*A61G 7/16* (2006.01)

(56) References Cited

U.S. PATENT DOCUMENTS

| | | | | |
|---|---|---|---|---|
| 4,240,169 | A * | 12/1980 | Roos | 5/613 |
| 4,987,620 | A * | 1/1991 | Sharon | 5/600 |
| 5,555,582 | A * | 9/1996 | Jerideau | 5/600 |
| 6,272,702 | B1 * | 8/2001 | Uchida et al. | 5/600 |
| 6,584,629 | B2 * | 7/2003 | Tsuji et al. | 5/618 |
| 6,742,206 | B1 * | 6/2004 | Han | 5/618 |
| 6,792,633 | B1 * | 9/2004 | Ito | 5/618 |
| 7,665,166 | B2 * | 2/2010 | Martin et al. | 5/611 |
| 8,474,075 | B2 * | 7/2013 | Kawakami et al. | 5/618 |
| 8,544,866 | B2 * | 10/2013 | Noonan et al. | 280/304.1 |
| 8,677,523 | B2 * | 3/2014 | Tsukada et al. | 5/86.1 |
| 8,677,524 | B2 * | 3/2014 | Kume et al. | 5/86.1 |
| 8,914,924 | B2 * | 12/2014 | Stryker et al. | 5/600 |
| 2001/0029629 | A1 * | 10/2001 | Tsuji et al. | 5/618 |
| 2007/0290468 | A1 * | 12/2007 | Martin et al. | 280/47.38 |
| 2010/0199422 | A1 * | 8/2010 | Patwardhan | 5/2.1 |
| 2012/0144582 | A1 * | 6/2012 | Gugliotti et al. | 5/86.1 |
| 2012/0159705 | A1 * | 6/2012 | Tsukada et al. | 5/2.1 |
| 2012/0292883 | A1 * | 11/2012 | Noonan et al. | 280/304.1 |
| 2014/0137328 | A1 * | 5/2014 | Ohta et al. | 5/611 |
| 2014/0191541 | A1 * | 7/2014 | Ohta et al. | 297/118 |
| 2014/0319804 | A1 * | 10/2014 | Tsukada et al. | 280/648 |

FOREIGN PATENT DOCUMENTS

| | | |
|---|---|---|
| JP | 2002-238953 | 8/2002 |
| JP | 2012-61200 | 3/2012 |

OTHER PUBLICATIONS

International Search Report (ISR) issued Sep. 10, 2013 in International (PCT) Application No. PCT/JP2013/004165.
Supplementary European Search Report issued Sep. 16, 2014 in corresponding European Patent Application No. EP 1381 3234.

* cited by examiner

MOVABLE BED

TECHNICAL FIELD

The present invention relates to a movable bed whose part is separable as a wheelchair.

BACKGROUND ART

In nursing care of a care-receiver, transferring the care-receiver between a wheelchair and a bed imposes a large burden on a caregiver. Therefore, in order to reduce the burden on the caregiver, there is a bed whose part can be separated and utilized as a wheelchair. The care-receiver is a bedridden aged person or an ailing person.

FIG. 8 shows a conventional movable bed 1. A bed surface of the movable bed 1 is composed of three bed plates including a side bed plate 2, a center bed plate 3, and a side bed plate 4. In order to compose the bed surface, there is a need for moving the center bed plate 3 of a platform truck 5 to a space 3*a* between the side bed plate 2 and the side bed plate 4. In a state where the side bed plate 4 is brought up to the upper side of a bed main body 1*a* by utilizing a rotation mechanism 1*b*, the caregiver moves the center bed plate 3 of the platform truck 5 to the space 3*a*. By returning the side bed plate 4 to the original position after the platform truck 5 is moved to the space 3*a*, the bed surface can be formed in the conventional movable bed 1.

The platform truck 5 separated from the movable bed 1 can also be utilized as the wheelchair. In that case, the center bed plate 3 serves as a seating surface of the wheelchair.

FIG. 9 is a side view of the platform truck 5. The center bed plate 3 of the platform truck 5 is composed of a back surface portion 3*b*, a leg portion 3*c*, and a bottom portion 3*d*. In this platform truck 5, by inclining the leg portion 3*c* in conjunction with inclination of the back surface portion 3*b* in a state where the bottom portion 3*d* serves as a horizontal surface, a posture of the center bed plate 3 is changed from a flat posture to a seating posture. In such a way, since the platform truck 5 has a chair posture formation mechanism, the platform truck can also be utilized as the wheelchair (for example, refer to Patent Literature 1).

CITATION LIST

Patent Literature

Patent Literature 1: Japanese Unexamined Utility Model Application Publication No. 5-51330

SUMMARY OF INVENTION

Technical Problem

However, with a configuration of the conventional movable bed, at the time of combining with the platform truck, a back lifting posture cannot be realized over the entire width of the bed.

Therefore, an object of the present invention is to provide a movable bed in which a back lifting posture can be performed over the entire width of the bed at the time of combining with a wheelchair.

Solution to Problem

In order to achieve the above object, a movable bed of the present invention is a movable bed, composed by combining a bed main portion and a wheelchair, being capable of supporting a bed back bottom of the bed main portion and a chair back bottom of the wheelchair from back surfaces by a first bed frame of the bed main portion at time of combination, and performing a back lifting action, wherein the wheelchair comprises:

a chair bottom portion composed by coupling a plurality of bottoms including the chair back bottom;

a chair base portion that supports the chair bottom portion;

a rail member arranged in the chair back bottom, and having a cutout portion; and a first chair frame installed rotatably about a rotation point with respect to the chair base portion, the first chair frame having a sliding portion engaged with the rail member so as to be slidable along the rail member and disengageable from the rail member in the cutout portion, and in a state where an inclination angle of the chair back bottom is 0°, the first chair frame and the chair back bottom are disengaged so as to be separable from each other by locating the sliding portion in the cutout portion, whereas in a state where the wheelchair is in a chair posture, the sliding portion is engaged with the rail member so as to be slidable along the rail member.

Effects of Invention

According to the present invention, the movable bed in which the back lifting posture can be performed over the entire width of the bed at the time of combining with the wheelchair can be provided.

DESCRIPTION OF EMBODIMENTS

An embodiment of the present invention will be described with reference to the drawings. It should be noted that the same constituent elements will be given the same reference signs, and description thereof will sometimes be omitted. For easy understanding, respective major constituent elements are schematically shown in the figures.

Figure 1:
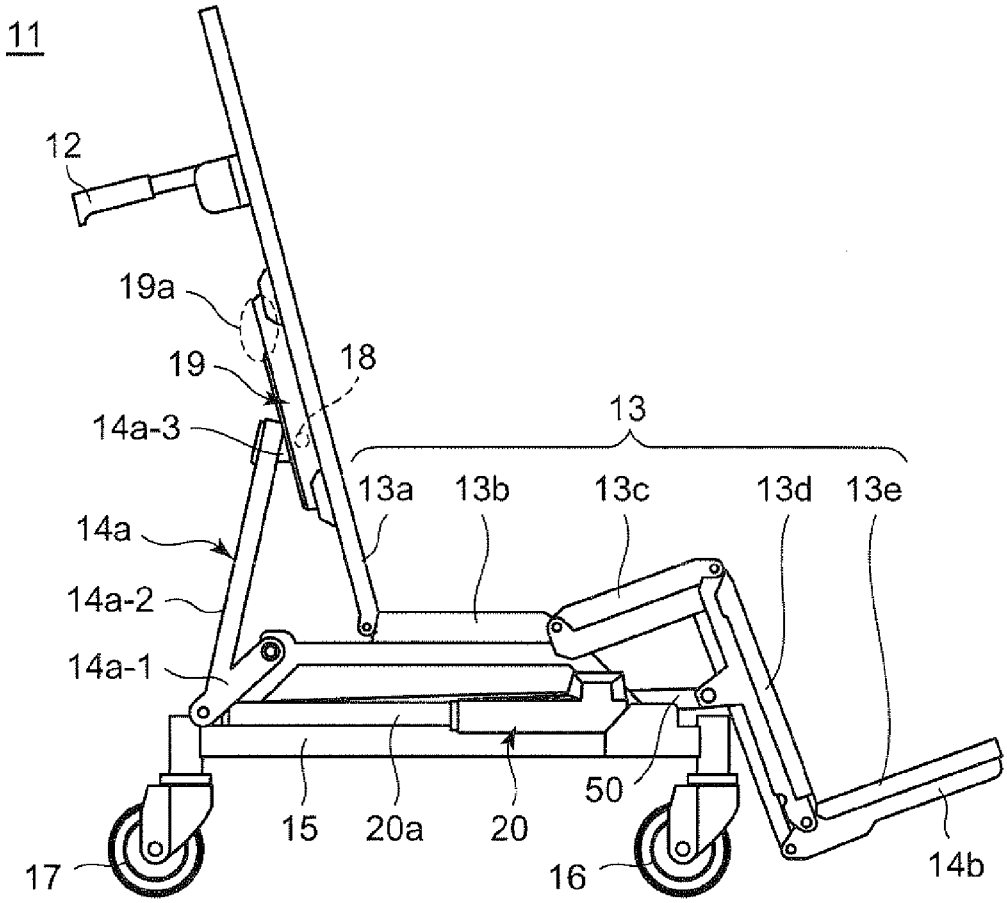
FIG. 1 is a side view of a first state of a wheelchair according to an embodiment of the present invention.
Figure 2:
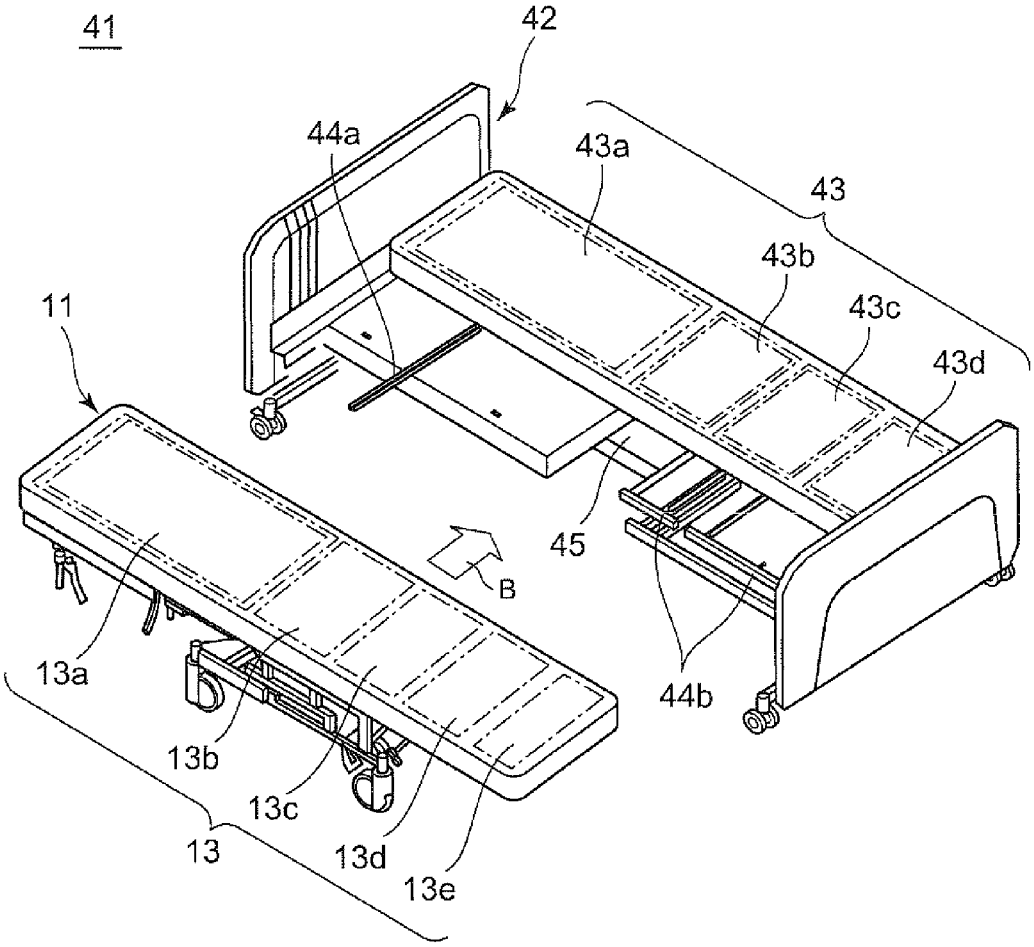
FIG. 2 is a perspective view of a movable bed before combination in the embodiment.
Figure 3A:
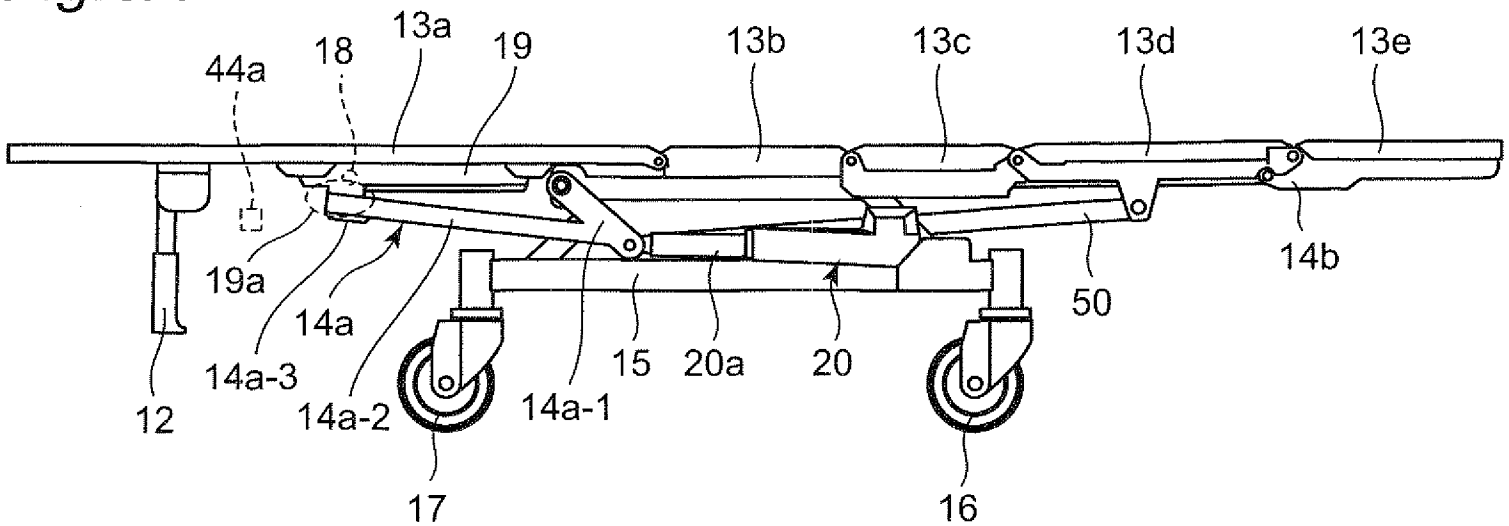
FIG. 3A is a side view of a fourth state of the wheelchair according to the embodiment of the present invention.
Figure 3B:
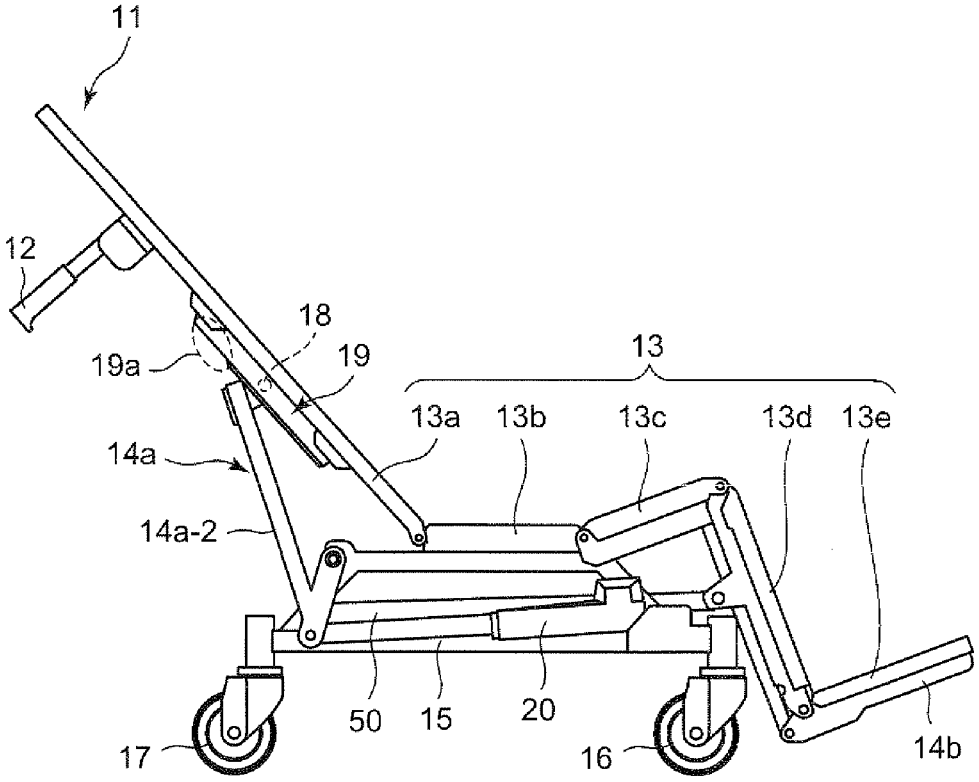
FIG. 3B is a side view of a second state of the wheelchair according to the embodiment of the present invention.
Figure 3C:
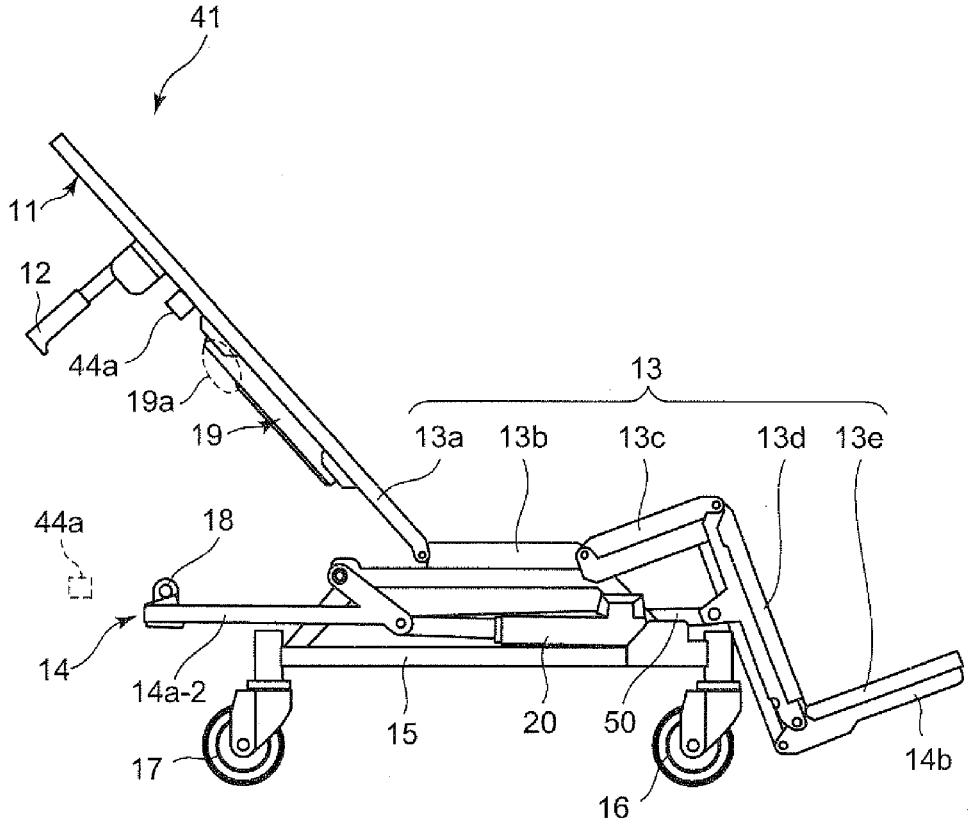
FIG. 3C is a side view of the second state of the wheelchair after the combination in the embodiment of the present invention.
Figure 3D:
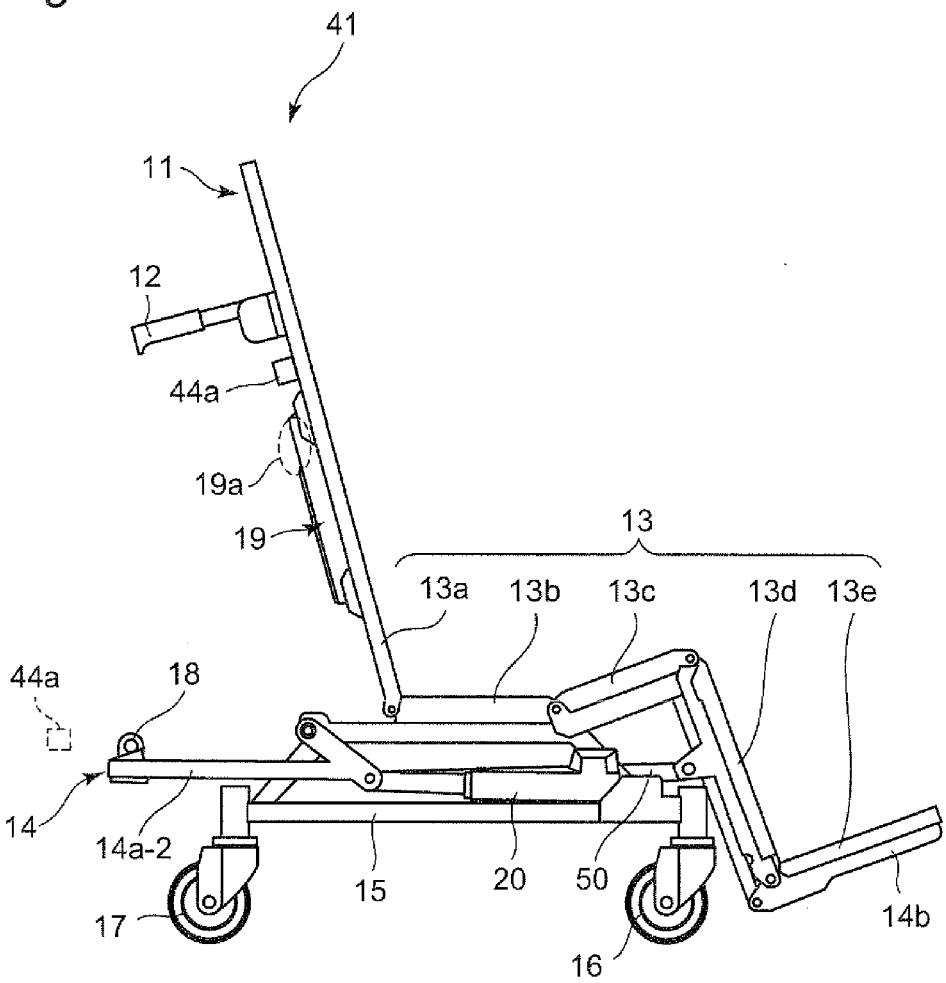
FIG. 3D is a side view of the first state of the wheelchair after the combination in the embodiment of the present invention.

FIG. 1 is a side view of a first state of a wheelchair 11 according to the embodiment of the present invention. FIG. 2 is a perspective view of a movable bed before combination in the embodiment of the present invention. FIG. 3A is a side view of a fourth state of the wheelchair 11. FIG. 3B is a side view of a second state of the wheelchair 11. FIG. 3C is a side view of the second state of the wheelchair 11 after the wheelchair 11 is combined with a bed main portion 42. FIG. 3D is a side view of the first state of the wheelchair 11 after the wheelchair 11 is combined with the bed main portion 42.

A movable bed 41 is formed by combining the wheelchair 11 and the bed main portion 42. The first state of the wheelchair 11 is a state where the wheelchair 11 is in a chair posture (seating posture), and an inclination angle of a first chair bottom 13*a* of the wheelchair 11 is about 75°. The second state of the wheelchair 11 is a state where the inclination angle of the first chair bottom 13*a* of the wheelchair 11 is about 45°. A third state of the wheelchair 11 is a state of a case where the inclination angle of the first chair bottom 13*a* of the wheelchair 11 is small, for example, in a state where the inclination angle of the first chair bottom 13*a* is 30° or less and 5° or more. The fourth state of the wheelchair 11 is a state where the wheelchair 11 is in a flat posture, and the inclination angle of the first chair bottom 13*a* of the wheelchair 11 is 0°. Regarding the state where the inclination angle is 0°, since the inclination angle may not easily be precise 0° in fact due to the mechanism, a state where the inclination angle is in a range of from 0° to 5° is defined as the state where the inclination angle is 0°.

The first chair bottom 13*a* is a chair back bottom, a second chair bottom 13*b* is a chair waist bottom, a third chair bottom 13*c* is a chair knee bottom, a fourth chair bottom 13*d* is a chair leg first bottom, and a fifth chair bottom 13*e* is a chair leg second bottom. The chair leg first bottom and the chair leg second bottom serve as a chair leg bottom in combination. A first chair frame 14*a* is a chair back guide member, and a second chair frame 14*b* is a chair leg guide member. A first bed bottom 43*a* is a bed back bottom, a second bed bottom 43*b* is a bed waist bottom, a third bed bottom 43*c* is a bed knee bottom, and a fourth bed bottom 43*d* is a bed leg bottom. A first bed frame 44*a* is a bed surface back guide member, and a second bed frame 44*b* is a bed surface leg guide member.

It should be noted that after the wheelchair 11 is combined with the bed main portion 42 shown in FIGS. 3A, 3C, 3D, when seen from the wheelchair side of the movable bed 41, the wheelchair 11 and the bed main portion 42 are in the same posture. Thus, a position of the first bed frame 44*a* to be described later is shown by an imaginary line.

Before describing a configuration of the movable bed 41 according to the embodiment of the present invention, an outline of actions of the movable bed 41 will be described.

A posture of the wheelchair 11 according to the present embodiment is changed from the first state shown in FIG. 1 to the fourth state shown in FIG. 3A. After that, the wheelchair 11 is inserted into and combined with the bed main portion 42 from the side so as to serve as a part of the movable bed 41. The movable bed 41 according to the present embodiment is a bed whose part can be separated as the wheelchair 11, and a back lifting posture where a backrest of the movable bed 41 (the first chair bottom 13*a* and the first bed bottom 43*a*) is lifted over the entire width of the bed can be performed as in a nursing care bed (refer to FIG. 7 to be described later).

The actions of the movable bed 41 will be described further in detail. Firstly, as shown in FIG. 2, after moving the wheelchair 11 to a vicinity position on the side of the bed main portion 42, a caregiver changes the wheelchair 11 from the first state to the fourth state. As described later, in the wheelchair 11, the first chair frame 14*a* and the second chair frame 14*b* are moved in conjunction with each other. Therefore, only by bringing down the first chair frame 14*a*, the second chair frame 14*b* is also brought down in conjunction, so that the wheelchair 11 is brought into the fourth state. When the wheelchair 11 is brought into the fourth state, the first chair bottom 13*a*, the second chair bottom 13*b*, the third chair bottom 13*c*, the fourth chair bottom 13*d*, and the fifth chair bottom 13*e* are on the same plane. By doing so, preparation for combining the wheelchair 11 with the bed main portion 42 is completed.

The wheelchair 11 is moved in the direction of an arrow B shown in FIG. 2, and the wheelchair 11 is combined with the bed main portion 42 from the side of the bed main portion 42. In the movable bed 41, when the wheelchair 11 is combined with the bed main portion 42, the first bed frame 44*a* supports the first bed bottom 43*a* and the first chair bottom 13*a* from the back surface side.

As shown in FIGS. 1 and 3A, the wheelchair 11 of the present embodiment includes at least a chair bottom portion 13, first rail members 19, the first chair frame 14*a*, the second chair frame 14*b*, a chair base portion 15, and a first actuator 20.

The first rail members 19 are fixed to the first chair bottom 13*a*, and function as one example of a rail member. The first actuator 20 moves the first chair frame 14*a* and the second chair frame 14*b* in conjunction, and performs back lifting of the wheelchair 11.

The chair bottom portion 13 couples the plurality of bottoms including the first chair bottom 13*a*.

Figure 4A:
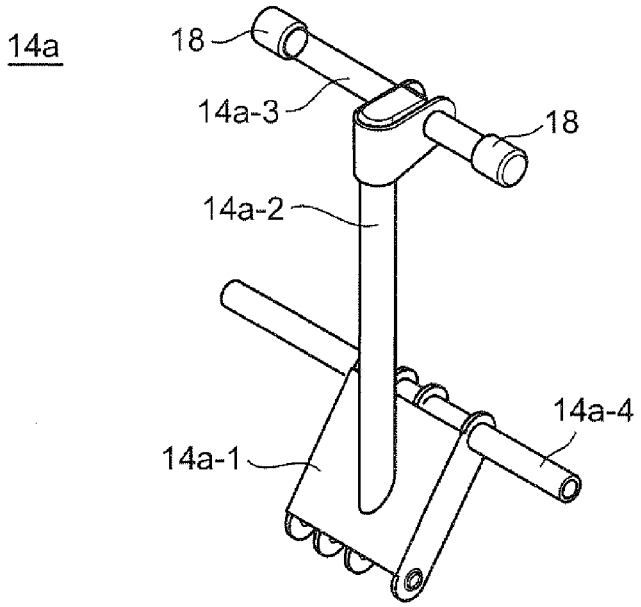
FIG. 4A is a perspective view of a first chair frame of the wheelchair according to the embodiment of the present invention.
Figure 4B:
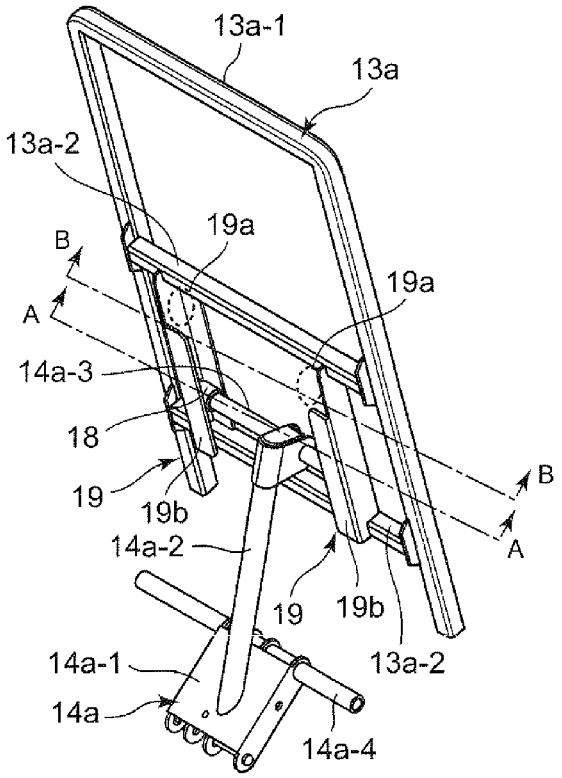
FIG. 4B is a perspective view of a first chair bottom and the first chair frame according to the embodiment of the present invention.

As shown in FIG. 4B, the first rail members 19 are composed of, for example, a pair of rail members fixed to a back surface of the first chair bottom 13*a*.

An upper end of the first chair frame 14*a* rotatably supports the back surface of the first chair bottom 13*a*.

The chair base portion 15 rotatably supports a lower end of the first chair frame 14*a*.

The first actuator 20 is respectively rotatably attached to the chair base portion 15 and the first chair frame 14*a*. One example of the first actuator 20 is composed of a motor, a ball screw to be rotated forward and backward by forward and backward rotation of the motor, and a rod member 20*a*. The rod member 20*a* is screwed to the ball screw and moved forward and rearward in one end of the first actuator 20 by the forward and backward rotation of the motor.

Cutout portions 19*a* are respectively provided on the head sides of the pair of first rail members 19. Rod shape sliding portions 18 to slide in the first rail members 19 are provided in the first chair frame 14*a*.

It should be noted that since the first rail members 19 are composed of the pair of left and right rail members in the present embodiment, strength is high against a force added in the twist direction through a handle 12. The handle 12 is a handle portion to be pushed by hand and fixed to an upper part of the back surface of the first chair bottom 13*a*. With the handle portion, the caregiver pushes the wheelchair 11 by hand.

The chair bottom portion 13 is composed of the first chair bottom 13*a*, the second chair bottom 13*b*, the third chair bottom 13*c*, the fourth chair bottom 13*d*, and the fifth chair bottom 13*e* respectively bendably coupled to each other. As shown in FIG. 4B, in the first chair bottom 13*a*, two lateral frames 13*a*-2 are combined with a U shape frame 13*a*-1. However, the first chair bottom may be composed in a plate surface shape. In FIG. 4B, between the two lateral frames 13*a*-2, the pair of first rail members 19 is fixed along the up and down direction. Lower ends of the first chair bottom 13*a* are bendably coupled about a pivot center (pivot point) of a rear end of the second chair bottom 13*b*. The second chair bottom 13*b* is fixed to the chair base portion 15. A front end of the second chair bottom 13*b* is bendably coupled to a rear end of the third chair bottom 13*c*. A front end of the third chair bottom 13*c* is bendably coupled to a rear end of the fourth chair bottom 13*d*. A front end of the fourth chair bottom 13*d* is bendably coupled to a rear end of the fifth chair bottom 13*e*. Respective lower surfaces of the third chair bottom 13*c*, the fourth chair bottom 13*d*, and the fifth chair bottom 13*e* are supported by the second chair frame 14*b* composed of three members which are bendable with respect to each other, the members respectively corresponding to the respective lower surfaces. A link rod 50 functioning as one example of a link member is coupled between a back surface of the second chair frame 14*b* supporting the lower surface of the fourth chair bottom 13*d* and a lower end of a first support portion 14*a*-1. Therefore, when the first chair guide portion 14*a* is pivoted clockwise and anticlockwise about an upper end of the first support portion 14*a*-1, the second chair frame 14*b* is moved in conjunction via the link rod 50, and the second chair frame 14*b* is bent between a Z shape bent state (refer to FIGS. 3B and 1) and a planar state of forming a single plane (refer to FIG. 3A). Thus, a chair guide portion is formed by the second chair frame 14*b*, the first chair frame 14*a*, and the link rod 50.

In front and rear lower ends of the chair base portion 15, first casters 16 serving as one example of front wheels and second casters 17 serving as one example of rear wheels are rollably arranged.

A case where the posture of the wheelchair 11 of the present embodiment is changed from the fourth state shown in FIG. 3A to the first state shown in FIG. 1 will be described. For example, by a lift action of starting drive of the first actuator 20 by the caregiver or the like and lifting the first chair bottom 13*a* by the handle 12, the wheelchair 11 starts a posture change to the first state. Firstly, by extending the rod member 20*a* of the first actuator 20, the first chair frame 14*a* is rotated clockwise in FIG. 3A with respect to the chair base portion 15 about a rotation shaft 14*a*-4 rotatably coupled to a rear end upper part of the chair base portion 15, and the first chair bottom 13*a* is lifted by the first chair frame 14*a* as shown in FIG. 1. At the same time, in conjunction with the action of the first chair frame 14*a*, the second chair frame 14*b* is bent into the Z shape bent state from the planar state by the link rod 50, and the third chair bottom 13*c*, the fourth chair bottom 13*d*, and the fifth chair bottom 13*e* are similarly lifted into the Z shape bent state from the planar state by the second chair frame 14*b*. In such a way, by lifting the chair bottom portion 13, the posture of the wheelchair 11 is changed from the fourth state to the first state.

Conversely, a case where the posture of the wheelchair 11 of the present embodiment is changed from the first state shown in FIG. 1 to the fourth state shown in FIG. 3A will be described. For example, by a pivoting action of starting reverse-drive of the first actuator 20 by the caregiver or the like and bringing down the first chair bottom 13*a* by the handle 12, the wheelchair 11 starts a posture change to the fourth state. Firstly, by contracting the rod member 20*a* of the first actuator 20, the first chair frame 14*a* is rotated anticlockwise in FIG. 1 with respect to the chair base portion 15 about the rotation shaft 14*a*-4 rotatably coupled to the rear end upper part of the chair base portion 15, and the first chair bottom 13*a* is laid by the first chair frame 14*a* as shown in FIG. 3A. At the same time, in conjunction with the action of the first chair frame 14*a*, the second chair frame 14*b* is moved into the planar state from the Z shape bent state by the link rod 50, and the third chair bottom 13*c*, the fourth chair bottom 13*d*, and the fifth chair bottom 13*e* are similarly laid into the planar state from the Z shape bent state by the second chair frame 14*b*. In such a way, by laying the chair bottom portion 13, the posture of the wheelchair 11 is changed from the first state to the fourth state.

The wheelchair 11 of the present embodiment is brought into an engaged state by an engagement mechanism 55 to be described later in the first state shown in FIG. 1. Thus, the first chair frame 14*a* and the first chair bottom 13*a* cannot be separated. The wheelchair 11 of the embodiment is brought into a disengaged state where engagement by the engagement mechanism 55 is cancelled in the fourth state shown in FIG. 3A. Thus, the first chair frame 14*a* and the first chair bottom 13*a* can be separated. The wheelchair 11 of the embodiment is composed in such a way. Thus, the posture can be changed by the first chair frame 14*a* in the first state, and the first chair frame 14*a* does not influence the posture change of the chair bottom portion 13 in the fourth state.

Hereinafter, a configuration of the engagement mechanism 55 realizing this function will be described with using FIGS. 4A, 4B, 5A, and 5B.

Figure 5A:
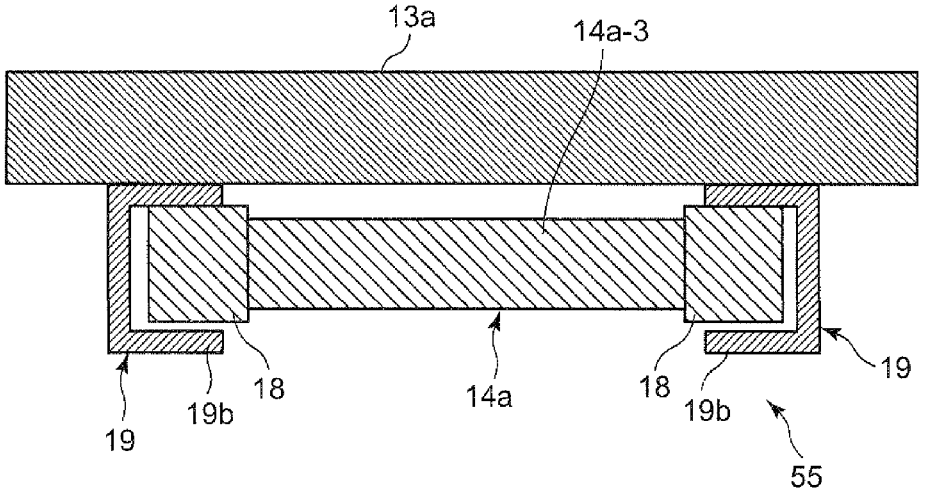
FIG. 5A is an end surface view of a cut surface by line A-A of the first chair bottom according to the embodiment of the present invention.
Figure 5B:
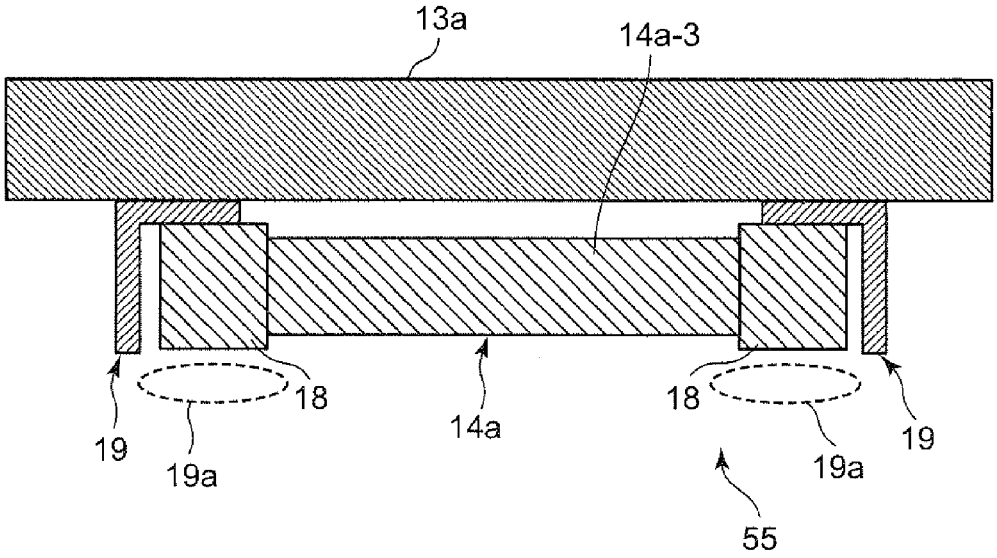
FIG. 5B is an end surface view of a cut surface by line B-B of the first chair bottom according to the embodiment of the present invention.

FIG. 4A is a perspective view of the first chair frame 14*a* when seen from the back surface side of the wheelchair 11. FIG. 4B is a perspective view of the first chair bottom 13*a* and the first chair frame 14*a* when seen from the back surface side of the wheelchair 11. FIG. 5A is an end surface view of a cut surface by line A-A of FIG. 4B of the first chair bottom 13*a*, and FIG. 5B is an end surface view of a cut surface by line B-B of FIG. 4B of the first chair bottom 13*a*. FIGS. 5A and 5B respectively show the end surface views of the cut surfaces in states where the sliding portions 18 are located on the sections.

As shown in FIG. 4A, the first chair frame 14*a* is composed of the first support portion 14*a*-1 in a lower part thereof, a second support portion 14*a*-2 in a center part thereof, and a third support portion 14*a*-3 in an upper part thereof. The first support portion 14*a*-1 is fixed to the rotation shaft 14*a*-4 and connected to a plurality of links. The second support portion 14*a*-2 stands from an intermediate part of the first support portion 14*a*-1. The third support portion 14*a*-3 protrudes to both sides in an upper end of the second support portion 14*a*-2. The upper end of the first support portion 14*a*-1 is rotatably coupled to the rear end upper part of the chair base portion 15 by the rotation shaft 14*a*-4. The lower end of the first support portion 14*a*-1 is rotatably coupled to a front end of the rod member 20*a* of the first actuator 20. The first chair frame 14*a* can be pivoted clockwise and anticlockwise about the rotation shaft 14*a*-4 upon transmitting a drive force from the rod member 20*a* of the first actuator 20.

The engagement mechanism 55 is composed as below including the sliding portions 18 and the first rail members 19.

Figure 3E:
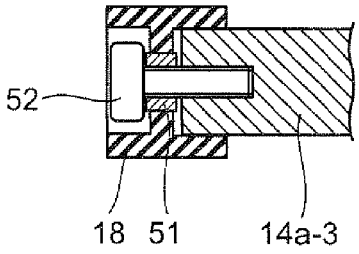
FIG. 3E is an enlarged sectional view of a sliding portion of the wheelchair according to the embodiment of the present invention.

As shown in FIGS. 4A, 5A, and the like, the sliding portions 18 are respectively attached to both ends of the third support portion 14*a*-3 as described above. The sliding portions 18 are members to slide in the first rail members 19 as shown in FIG. 4B. It should be noted that the sliding portions 18 may be attached and fixed to the third support portion 14*a*-3 as shown in FIG. 4B or may be rotatably attached. In a case where the sliding portions 18 are rotatably attached, for example, as shown in FIG. 3E, the sliding portions 18 are composed of rollers of rubber or the like respectively rollably attached to both the ends of the third support portion 14*a*-3 by bolts 52 via bearing members 51, or sliding rollers attached so as to be fixed by the bolts 52.

Sections of the first rail members 19 are formed into a "U" shape as shown in FIG. 4B. While maintaining the engaged state by preventing removal from the first rail members 19 by plate shape engagement plate portions 19*b* extended on the back surface side of the "U" shape, the sliding portions 18 can slide in the "U" shape of the first rail members 19 as shown in FIG. 5A. In upper ends of the first rail members 19, the cutout portions 19*a* are formed by cutting parts of the engagement plate portions 19*b*. Since no engagement plate portions 19*b* exist in the cutout portions 19*a*, the sliding portions 18 are removable (disengageable) from the chair back bottom rails 19 in the cutout portions 19*a*.

Figure 3F:
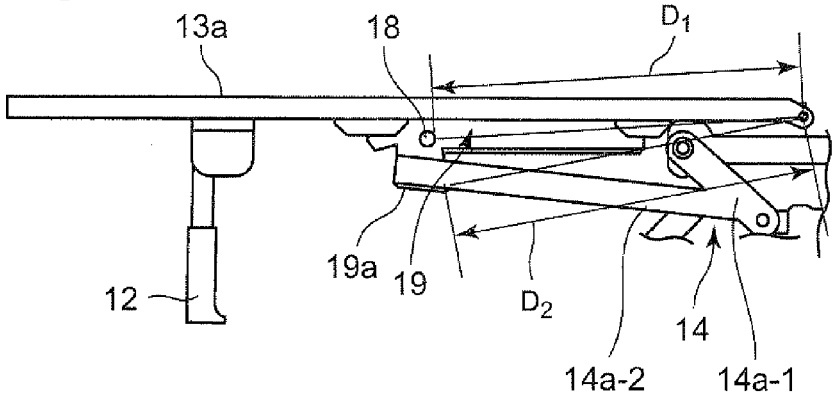
FIG. 3F is an illustrative view for illustrating a size configuration in the vicinity of a cutout portion of the wheelchair according to the embodiment of the present invention.

As shown in FIG. 3F, the cutout portions 19*a* are formed in such a manner that $D_1>D_2$ is established in a relationship between a distance $D_1$ and a distance $D_2$. The distance $D_1$ is a shortest distance from a first pivot center (pivot point) bendably (pivotably) coupled between the lower end of the first chair bottom 13*a* and the rear end of the second chair bottom 13*b* to a center of the cutout portion 19*a* (position where the sliding portion 18 is removable in the cutout portion 19*a*). The distance $D_2$ is a shortest distance from the first pivot center to an edge of the cutout portion 19*a*. That is, in the wheelchair 11 of the present embodiment, the distance $D_1$ between an outer surface of the sliding portion 18 and the pivot center in the longitudinal direction of the wheelchair 11 in the fourth state is larger than the distance $D_2$ between an end of the cutout portion 19*a* and the pivot center. For example, a difference between the distance $D_1$ and the distance $D_2$ is an error margin (such as 2 mm) or more. By designing in such a way, only when the wheelchair 11 is in the fourth state, the sliding portions 18 can be reliably disengaged in the cutout portions 19*a*.

The sliding portions 18 can be disengaged only in the fourth state for the following reasons. For example, in a case where a care-receiver suffers from contracture, only the wheelchair 11 with the first chair bottom 13*a* in the third state may be used. In a case where the wheelchair is used as the wheelchair 11 at such a small inclination angle, if the sliding portions 18 are erroneously disengaged and separated from the first rail members 19, there would be a difficulty in using the wheelchair 11 as a wheelchair. Therefore, in the wheelchair 11 of the present embodiment, as the design described above, the sliding portions 18 can be disengaged only in the fourth state.

Next, with using FIGS. 4B, 5A, and 5B, engagement actions in the engagement mechanism 55 between the sliding portions 18 and the first rail members 19 along with the posture change of the wheelchair 11 will be described.

When the wheelchair 11 is in the first state as shown in FIG. 1, the sliding portions 18 are located in the first rail members 19 on the waist side (near a waist) when the care-receiver sits in the wheelchair 11, and sections thereof are in the state of FIG. 5A. At this time, the sliding portions 18 are located in the first rail members 19 and cannot be removed by the engagement plate portions 19*b* of the first rail members 19. Therefore, for example, when the caregiver pushes the handle 12, the sliding portions 18 are brought into contact with the engagement plate portions 19*b* of the first rail members 19, so that the first chair frame 14*a* and the first chair bottom 13*a* cannot go away from each other. That is, in the first state shown in FIG. 1, the first chair frame 14*a* and the first chair bottom 13*a* do not go away from each other but are integrated to function, and the first chair frame 14*a* is actuated in correspondence to an action of the handle 12, so that a helper can move the wheelchair as in a case of a normal wheelchair.

Meanwhile, when the wheelchair 11 is in the fourth state shown in FIG. 3A, the sliding portions 18 are located in the first rail members 19 on the head side (near a head) when the care-receiver lies on the wheelchair 11, and the sections thereof are in the state of FIG. 5B. At this time, the first chair bottom 13*a* is only set on the sliding portions 18 and located in the cutout portions 19*a* of the first rail members 19 without the engagement plate portions 19*b*. Thus, the first chair bottom can be removed. Therefore, when the first chair bottom 13*a* is pivoted in a clockwise direction in FIG. 3A with respect to the chair base portion 15, the sliding portions 18 pass through the cutout portions 19*a* of the first rail members 19 and go away from the first rail members 19, so that the first chair bottom 13*a* goes away from the first chair frame 14*a*. That is, in the fourth state of the wheelchair 11 shown in FIG. 3A, the first chair bottom 13*a* is separated from the first chair frame 14*a* and independently actuated, so that only the first chair bottom 13*a* can be pivoted in a state where a posture of the first chair frame 14*a* is not changed.

With such a configuration, in the wheelchair 11 of the present embodiment, the back lifting posture can be executed over the entire width of the bed at the time of combining with the movable bed 41 to be described later. This will be described with using FIGS. 2 and 7.

FIG. 2 is the perspective view of the movable bed 41 before the combination in the present embodiment.

Figure 6:
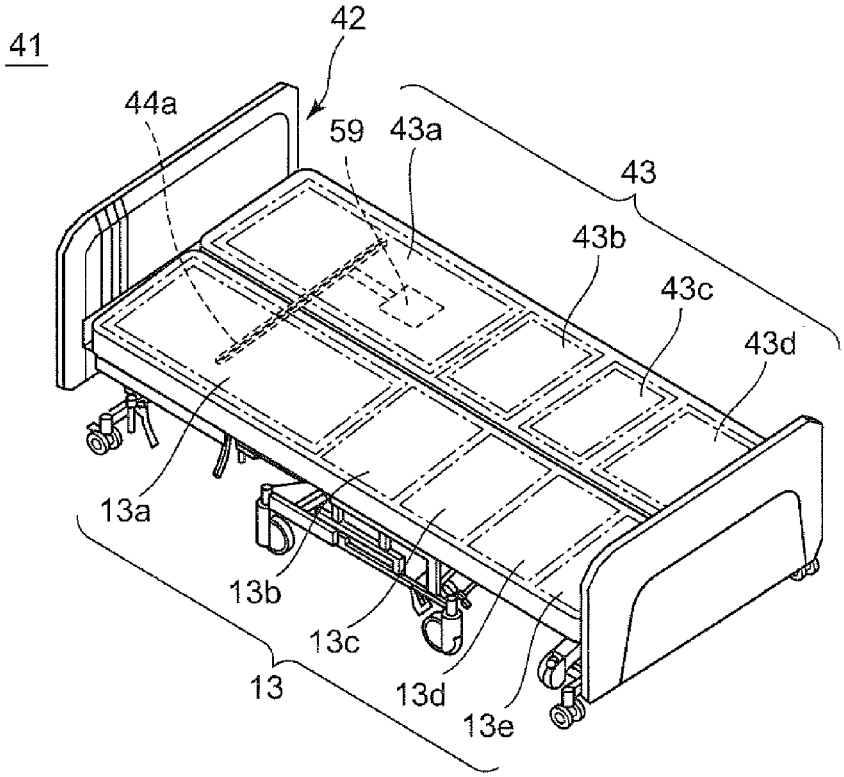
FIG. 6 is a perspective view of the movable bed after the combination in the embodiment.

The movable bed 41 is set in a bed mode by combining the wheelchair 11 and the bed main portion 42 (refer to FIG. 6). The bed main portion 42 has a bed bottom portion 43 in which the plurality of bottoms 43*a* to 43*d* including the first bed bottom 43*a* is coupled, the first bed frame 44*a* supporting the first bed bottom 43*a* from the back surface side, and a bed base portion 45 pivotably supporting the first bed frame 44*a*. The bed bottom portion 43 is composed of the first bed bottom 43*a*, the second bed bottom 43*b*, the third bed bottom 43*c*, and the fourth bed bottom 43*d* respectively bendably coupled to each other. The second bed bottom 43*b* is fixed to the bed base portion 45. The third bed bottom 43*c* and the fourth bed bottom 43*d* are supported by the second bed frame 44*b* and bendably composed.

Figure 7:
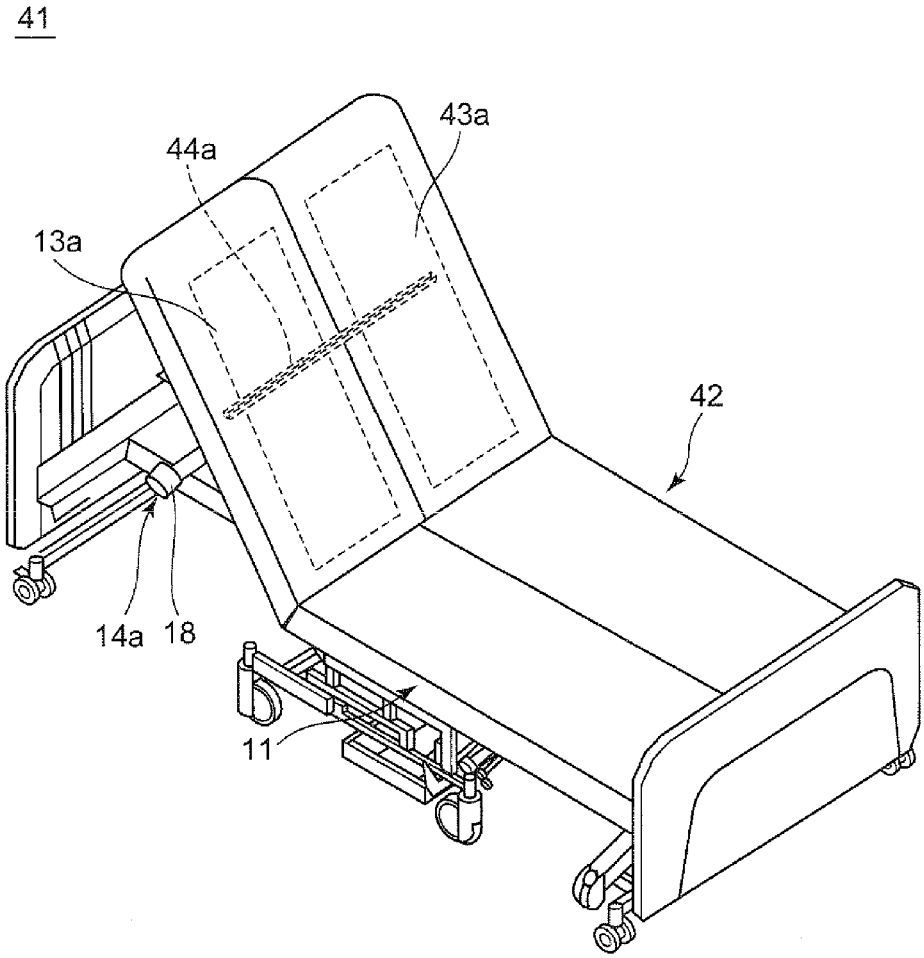
FIG. 7 is a perspective view of the movable bed after the combination in the embodiment during a back lifting action.
Figure 8:
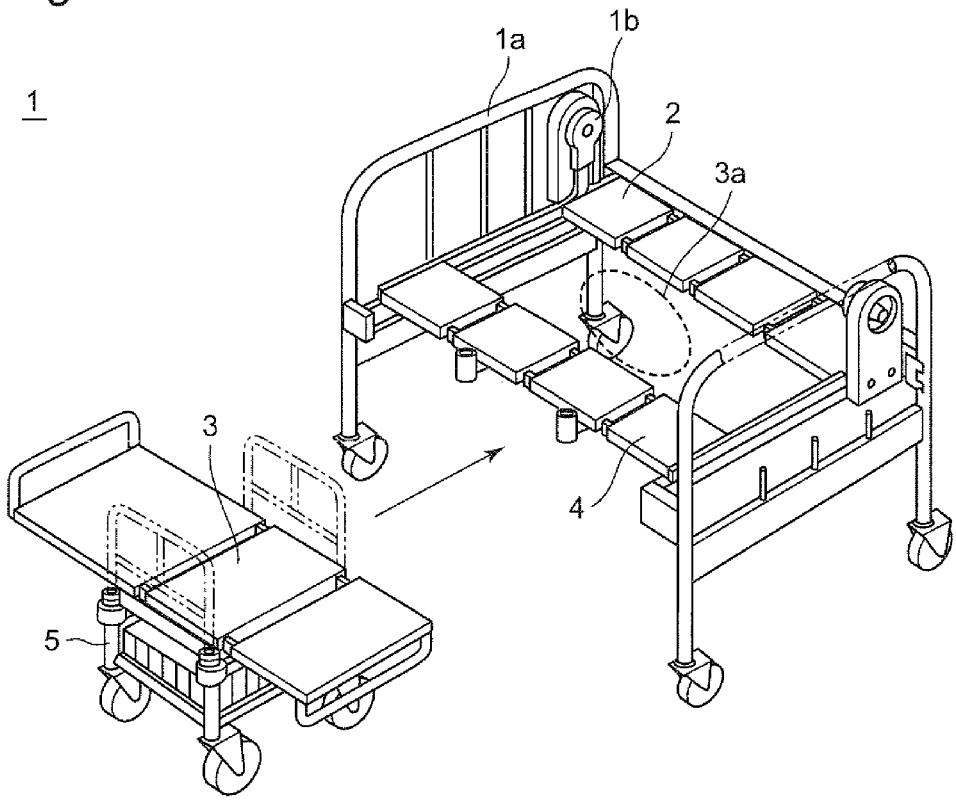
FIG. 8 is a perspective view of a conventional movable bed.
Figure 9:
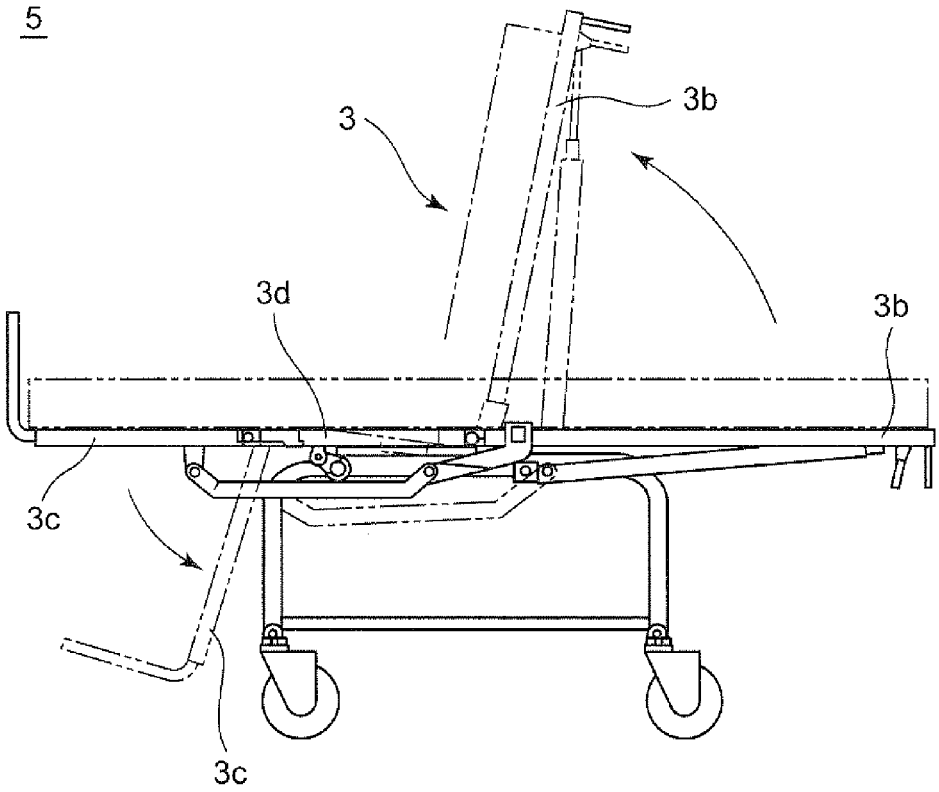
FIG. 9 is a side view of a wheelchair separated from the conventional movable bed.

FIGS. 6 and 7 are perspective views of the movable bed 41 in the present embodiment.

As shown in FIGS. 6 and 7, in the movable bed 41 in which the wheelchair 11 is combined with the bed main portion 42, by pivoting and pushing up the first bed frame 44*a* with respect to the bed base portion 45 by a back lifting drive device 59, both the first chair bottom 13*a* and the first bed bottom 43*a* supported by the first bed frame 44*a* can be back-lifted at the same time (refer to FIG. 7). The back lifting drive device 59 is composed of for example, a motor to be rotated forward and backward, and a link mechanism capable of driving the first bed frame 44*a* by forward and backward rotation of the motor.

Effects of the fact that the wheelchair 11 of the present embodiment includes the sliding portions 18 and the cutout portions 19*a* of the chair back bottom rails 19 will be described. Since the wheelchair 11 of the present embodiment has the sliding portions 18 and the cutout portions 19*a*, the first chair bottom 13*a* and the first chair frame 14*a* can be separated in accordance with a situation. Meanwhile, if the first chair bottom 13*a* and the first chair frame 14*a* are completely inseparable, there is a possibility that the mechanism of the movable bed 41 and the first actuator 20 are broken down upon changing the posture of the wheelchair 11 to the first state in a state where the wheelchair 11 is combined with the movable bed 41 due to the action of the first chair frame 14*a* in conjunction with the second chair frame 14*b*.

However, at the time of utilizing the wheelchair 11 as a wheelchair, there is a need for bringing the first chair bottom 13*a* and the first chair frame 14*a* into an inseparable engaged state as shown in FIGS. 1 and 3B. This is for the following reason. That is, when the handle 12 is pushed by the caregiver in order to move the wheelchair 11, if the first chair bottom 13*a* and the first chair frame 14*a* go away from each other, the wheelchair 11 itself is not moved but the first chair bottom 13*a* is rotated with respect to the second chair bottom 13*b*. Thus, there is a possibility that the waist of the care-receiver is bent and injured.

Desirably, the first chair bottom 13*a* and the first chair frame 14*a* are brought into a separable state (removable state) in the fourth state (refer to FIG. 3A) after combining with the movable bed 41, and into an inseparable state (engaged state) in the first state (refer to FIGS. 1 and 3B). In order to realize this, the wheelchair 11 of the present embodiment includes the sliding portions 18, the chair back bottom rails 19, and the cutout portions 19*a* as described above.

As described above, in the wheelchair 11 of the present embodiment, since the bed bottom portion 43 and the chair bottom portion 13 are on the same plane at the time of being used as the movable bed 41, the chair bottom portion 13 is brought into the fourth state. As shown in FIG. 4B, by providing the cutout portions 19*a* on the head side of the first rail members 19, when the chair bottom portion 13 is brought into the fourth state, the first chair bottom 13*a* and the first chair frame 14*a* can go away from each other, and as shown in FIGS. 3C and 3D, the movable bed 41 can have a configuration that is not broken down due to the posture change of the chair bottom portion 13.

At the time of separating the wheelchair 11 of the present embodiment from the movable bed 41 and utilizing the same as a wheelchair, by being brought into the first state, the first chair bottom 13*a* and the first chair frame 14*a* are actuated in conjunction with each other. Therefore, in the present embodiment, when the caregiver pushes the wheelchair 11 with the handle 12 in hand at the time of moving the wheelchair 11, the first chair bottom 13*a* is not rotated with respect to the second chair bottom 13*b* and the care-receiver is not injured.

Thus, at the time of being used as a wheelchair, the wheelchair 11 of the present embodiment can be brought into the seating posture as shown in FIGS. 1 and 3B, and at the time of being combined, the movable bed 41 in which the back lifting posture can be performed over the entire width of the bed as shown in FIGS. 3C, 3D, and 7 can be realized. This can be realized by the fact that the sliding portions 18 can slide in the first rail members 19 and the fact that the cutout portions 19*a* are located on the head side of the first rail members 19 as described above. As a result, in the present embodiment, the wheelchair 11 and the movable bed 41 having high safety can be provided.

It should be noted that as shown in FIG. 2, the example that a right half (on the left side on the drawing) of the movable bed 41 is separated as the wheelchair 11 is described in the present embodiment. However, in addition to a case where the right half of the movable bed 41 is separated as the wheelchair 11, the present invention has the same effects also in a case where a left half (on the right side on the drawing) of the movable bed 41 is separated as the wheelchair 11.

The posture at the time of combining the wheelchair 11 and the bed main portion 42 is described as the fourth state. However, it should be noted that as long as the posture after the combination is in the fourth state, the posture of the wheelchair 11 before the combination is not limited to in the fourth state but may be in a tilt posture (fifth state). The tilt posture is a posture where tilt of inclining the entire chair bottom portion 13 of the wheelchair 11 is performed in a state where the second chair bottom 13*b* and the first chair bottom 13*a* of the wheelchair 11 are at the same angle. When the posture of the wheelchair 11 before the combination is in the tilt posture, the wheelchair can be combined while a passenger of the wheelchair 11 is in a relaxing posture, so that a load on the passenger of the wheelchair 11 can be reduced.

It should be noted that although the casters are used as one example of the wheels, wheels to which electromotive power of a motor or the like is connected may be used.

By properly combining the arbitrary embodiment(s) or modification(s) of the aforementioned various embodiments and modifications, the effects possessed by the embodiment(s) or modification(s) can be produced.

INDUSTRIAL APPLICABILITY

In the movable bed according to the present invention, the back lifting posture can be performed over the entire width of the bed at the time of combining with the wheelchair. The movable bed is highly safe and useful as a wheelchair and a bed for nursing care of, for example, a bedridden aged person or an ailing person.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A movable bed, composed by combining a bed main portion and a wheelchair, being capable of supporting a bed back bottom of the bed main portion and a chair back bottom of the wheelchair from back surfaces by a first bed frame of the bed main portion at time of combination, and performing a back lifting action, wherein the wheelchair comprises:

a chair bottom portion composed by coupling a plurality of bottoms including the chair back bottom;

a chair base portion that supports the chair bottom portion;

a rail member arranged in the chair back bottom, and having a cutout portion; and a first chair frame installed rotatably about a rotation point with respect to the chair base portion, the first chair frame having a sliding portion engaged with the rail member so as to be slidable along the rail member and disengageable from the rail member in the cutout portion, and in a state where an inclination angle of the chair back bottom is 0°, the first chair frame and the chair back bottom are disengaged so as to be separable from each other by locating the sliding portion in the cutout portion, whereas in a state where the wheelchair is in a chair posture, the sliding portion is engaged with the rail member so as to be slidable along the rail member.

2. The movable bed according to claim 1, wherein when both the wheelchair and the bed main portion are in a state of a back lifting posture, the chair back guide portion is separated from the chair back bottom by dropping the sliding portion off the rail member from the cutout portion, and the first bed frame is brought into contact with the chair back bottom so as to support the chair back bottom.

3. The movable bed according to claim 2, wherein the chair bottom portion is composed of the chair back bottom, a chair waist bottom, and a chair leg bottom, and at time of combining the wheelchair and the bed main portion, the first bed frame supports the chair back bottom, and a second bed frame of the bed main portion supports the chair leg bottom.

4. The movable bed according to claim 2, wherein the rail member is composed of a pair of U shape members.

5. The movable bed according to claim 2, wherein a shortest distance $D_1$ from a first pivot center between the chair back bottom and the chair waist bottom to a center of the cutout portion, and a shortest distance $D_2$ from the first pivot center to an edge of the cutout portion are in a relationship of $D_1>D_2$.

6. The movable bed according to claim 2, wherein the sliding portion is composed of a roller rollably attached by a bolt or a sliding roller attached so as to be fixed by a bolt.

7. The movable bed according to claim 2, wherein the first chair frame is composed of a first support portion to which a plurality of links is connected, a second support portion standing from an intermediate part of the first support portion, and a third support portion protruding to both sides in an upper end of the second support portion, and an upper end of the first support portion is rotatably coupled to a rear end upper part of the chair base portion of the wheelchair by a rotation shaft.

8. The movable bed according to claim 7, comprising:

a first actuator that has a rod member and drives the first chair frame, wherein a front end of the rod member is rotatably coupled to a lower end of the first support portion, and the rod member transmits a drive force to the first chair frame.

9. The movable bed according to claim 1, wherein the chair bottom portion is composed of the chair back bottom, a chair waist bottom, and a chair leg bottom, and at time of combining the wheelchair and the bed main portion, the first bed frame supports the chair back bottom, and a second bed frame of the bed main portion supports the chair leg bottom.

10. The movable bed according to claim 1, wherein the rail member is composed of a pair of U shape members.

11. The movable bed according to claim 1, wherein a shortest distance $D_1$ from a first pivot center between the chair back bottom and the chair waist bottom to a center of the cutout portion, and a shortest distance $D_2$ from the first pivot center to an edge of the cutout portion are in a relationship of $D_1>D_2$.

12. The movable bed according to claim 1, wherein the sliding portion is composed of a roller rollably attached by a bolt or a sliding roller attached so as to be fixed by a bolt.

13. The movable bed according to claim 1, wherein the first chair frame is composed of a first support portion to which a plurality of links is connected, a second support portion standing from an intermediate part of the first support portion, and a third support portion protruding to both sides in an upper end of the second support portion, and an upper end of the first support portion is rotatably coupled to a rear end upper part of the chair base portion of the wheelchair by a rotation shaft.

14. The movable bed according to claim 13, comprising:

a first actuator that has a rod member and drives the first chair frame, wherein a front end of the rod member is rotatably coupled to a lower end of the first support portion, and the rod member transmits a drive force to the first chair frame.

* * * * *